US007188548B2

(12) United States Patent
Liess

(10) Patent No.: US 7,188,548 B2
(45) Date of Patent: Mar. 13, 2007

(54) ADAPTER FRAME FOR A POWER FRAME

(75) Inventor: Martin Liess, Seeize (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/945,568

(22) Filed: Sep. 20, 2004

(65) Prior Publication Data

US 2005/0061112 A1 Mar. 24, 2005

Related U.S. Application Data

(60) Provisional application No. 60/503,822, filed on Sep. 19, 2003.

(51) Int. Cl.
*B24B 29/00* (2006.01)

(52) U.S. Cl. ..... 81/57.24; 81/57.16; 81/57.34; 81/57.25

(58) Field of Classification Search ..... 81/57–57.37, 81/57.4

See application file for complete search history.

(56) References Cited

U.S. PATENT DOCUMENTS

| | | | |
|---|---|---|---|
| 1,386,908 | A | 8/1921 | Taylor |
| 1,842,638 | A | 1/1932 | Wigle |
| 2,214,194 | A | 9/1940 | Frankley |
| 2,214,429 | A | 9/1940 | Miller |
| 2,522,444 | A | 9/1950 | Grable |
| 2,610,690 | A | 9/1952 | Beatty |
| 2,668,689 | A | 2/1954 | Gormany |
| 2,950,639 | A | 8/1960 | Mason |
| 3,021,739 | A | 2/1962 | Grundmann |
| 3,041,901 | A | 7/1962 | Knights |
| 3,086,413 | A | 4/1963 | Mason |
| 3,122,811 | A | 3/1964 | Gilreath |
| 3,131,586 | A | 5/1964 | Wilson |
| 3,180,186 | A | 4/1965 | Catland |
| 3,220,245 | A | 11/1965 | Winkle |
| 3,288,000 | A | 11/1966 | Foster |
| 3,302,496 | A | 2/1967 | Mitchell et al. |
| 3,349,455 | A | 10/1967 | Doherty |
| 3,443,291 | A | 5/1969 | Doherty |
| 3,475,038 | A | 10/1969 | Matherne |
| 3,518,903 | A | 7/1970 | Ham et al. |
| 3,559,739 | A | 2/1971 | Hutchison |

(Continued)

FOREIGN PATENT DOCUMENTS

| | | |
|---|---|---|
| DE | 2 128 362 | 1/1972 |

(Continued)

OTHER PUBLICATIONS

EP Search Report, Application No. EP 04022141, dated Dec. 27, 2004.

(Continued)

*Primary Examiner*—Lee D. Wilson
*Assistant Examiner*—Robert Scruggs
(74) *Attorney, Agent, or Firm*—Patterson & Sheridan, LLP

(57) ABSTRACT

In one embodiment, an adapter frame is provided for use with a power frame to support a tong assembly. When the adapter frame is coupled to the power frame, the load capacity of the power frame is increased, thereby allowing the power frame to be used with larger tongs or tong assemblies such as a riser tong.

31 Claims, 11 Drawing Sheets

U.S. PATENT DOCUMENTS 3,606,664 A 9/1971 Weiner
3,680,412 A 8/1972 Mayer et al.
3,722,331 A 3/1973 Radulescu
3,747,675 A 7/1973 Brown
3,760,658 A * 9/1973 Guier ..... 81/57.34
3,796,418 A 3/1974 Carlberg
3,803,953 A 4/1974 Stampfil
3,808,916 A 5/1974 Porter et al.
3,838,613 A 10/1974 Wilms
3,857,451 A 12/1974 Williams
3,902,561 A 9/1975 Friberg et al.
3,933,108 A 1/1976 Baugh
3,941,348 A 3/1976 Mott
3,986,564 A 10/1976 Bender
4,005,621 A 2/1977 Turner, Jr. et al.
4,142,739 A 3/1979 Billingsley
4,159,637 A 7/1979 Lamb et al.
4,170,908 A 10/1979 Peveto et al.
4,221,269 A 9/1980 Hudson
4,246,809 A 1/1981 Keast et al.
4,257,442 A 3/1981 Claycomb
4,262,693 A 4/1981 Giebeler
4,280,380 A 7/1981 Eshghy
4,291,762 A 9/1981 Gudgel
4,295,527 A 10/1981 Russe
4,315,553 A 2/1982 Stallings
4,334,444 A 6/1982 Carstensen et al.
4,346,629 A 8/1982 Kinzbach
4,348,920 A * 9/1982 Boyadjieff ..... 81/57.25
4,401,000 A 8/1983 Kinzbach
4,402,239 A 9/1983 Mooney
4,442,892 A 4/1984 Delesandri
RE31,699 E 10/1984 Eckel
4,492,134 A 1/1985 Reinholdt et al.
4,499,919 A 2/1985 Forester
4,565,003 A 1/1986 McLeod
4,573,359 A 3/1986 Carstensen
4,585,079 A * 4/1986 Lemaire et al. ..... 173/164
4,592,125 A * 6/1986 Skene ..... 29/407.03
4,593,773 A 6/1986 Skeie
4,619,159 A * 10/1986 Kurek ..... 81/57.34
4,643,259 A 2/1987 Zeringue, Jr.
4,649,777 A 3/1987 Buck
4,709,766 A 12/1987 Boyadjieff
4,712,284 A 12/1987 Coyle, Sr. et al.
4,715,625 A 12/1987 Shows, Jr. et al.
4,727,781 A 3/1988 Yuehui et al.
4,734,081 A 3/1988 Neathery et al.
4,738,145 A 4/1988 Vincent et al.
4,773,218 A 9/1988 Wakita et al.
4,811,635 A 3/1989 Falgout, Sr.
4,843,945 A 7/1989 Dinsdale
4,938,109 A 7/1990 Torres et al.
4,979,356 A 12/1990 Vatne
5,000,065 A 3/1991 Haynes
5,022,472 A 6/1991 Bailey et al.
5,044,232 A 9/1991 Schulze-Beckinghausen
5,060,542 A 10/1991 Hauk
5,092,399 A 3/1992 Lang
RE34,063 E 9/1992 Vincent et al.
5,150,642 A 9/1992 Moody et al.
5,159,860 A 11/1992 Pietras
5,161,438 A 11/1992 Pietras
5,167,173 A 12/1992 Pietras
5,209,302 A 5/1993 Robichaux et al.
5,221,099 A 6/1993 Jansch
5,245,265 A 9/1993 Clay
5,259,275 A * 11/1993 Schulze-Beckinghausen ..... 81/57.16
5,297,833 A 3/1994 Willis et al.
5,297,874 A 3/1994 Raines
5,386,746 A * 2/1995 Hauk ..... 81/57.34
5,390,568 A * 2/1995 Pietras ..... 81/57.16
5,451,084 A 9/1995 Jansch
5,520,072 A 5/1996 Perry
5,634,671 A 6/1997 Watkins
5,706,893 A 1/1998 Morgan
5,730,471 A 3/1998 Schulze-Beckinghausen et al.
5,746,276 A 5/1998 Stuart
5,758,553 A * 6/1998 Perry ..... 81/57.34
5,787,982 A 8/1998 Bakke
5,819,605 A 10/1998 Buck et al.
5,839,330 A 11/1998 Stokka
5,842,390 A 12/1998 Bouligny et al.
5,845,549 A 12/1998 Bouligny
5,868,045 A * 2/1999 Hauk ..... 81/57.16
5,890,549 A 4/1999 Sprehe
5,992,801 A 11/1999 Torres
6,065,372 A 5/2000 Rauch
6,082,224 A 7/2000 McDaniels et al.
6,082,225 A 7/2000 Richardson
6,119,772 A 9/2000 Pruet
6,138,529 A 10/2000 Pietras
6,142,040 A 11/2000 Bouligny
6,142,041 A * 11/2000 Buck ..... 81/57.35
6,161,617 A 12/2000 Gjedebo
6,206,096 B1 3/2001 Belik
6,223,629 B1 5/2001 Bangert
6,263,763 B1 * 7/2001 Feigel et al. ..... 81/57.34
6,305,720 B1 10/2001 Spiering et al.
6,327,938 B1 12/2001 Pietras
6,330,911 B1 12/2001 Allen et al.
6,360,633 B2 * 3/2002 Pietras ..... 81/57.34
6,374,706 B1 4/2002 Newman
6,412,554 B1 7/2002 Allen et al.
6,480,811 B2 11/2002 Denny et al.
6,488,094 B1 * 12/2002 McDowell ..... 166/379
6,776,070 B1 * 8/2004 Mason et al. ..... 81/57.35
2002/0035897 A1 * 3/2002 Buytaert et al. ..... 81/57.35
2002/0104408 A1 * 8/2002 Hawkins, III ..... 81/57.25
2002/0157823 A1 * 10/2002 Pietras et al. ..... 166/78.1
2004/0216890 A1 * 11/2004 Hemphill et al. ..... 166/380

FOREIGN PATENT DOCUMENTS

DE 3523221 2/1987
EP 0 087 373 8/1983
EP 0 285 386 5/1988
EP 0 339 005 10/1989
EP 0 311 455 12/1989
EP 0 423 055 4/1991
GB 1 215 967 12/1970
GB 2 009 705 6/1979
GB 2 049 518 12/1980
GB 2 115 940 9/1983
GB 2 128 526 5/1984
GB 2 201 912 9/1988
GB 2 300 896 A 11/1996
GB 2 346 576 8/2000
GB 2 346 577 8/2000
WO WO 82/00428 2/1982
WO WO 83/03443 10/1983
WO WO 93/18276 9/1993
WO WO 95/20471 8/1995
WO WO 98/16716 4/1998
WO WO 98/32948 7/1998
WO WO 99/34089 7/1999
WO WO 99/34090 7/1999
WO WO 99/34091 7/1999
WO WO 00/22278 4/2000
WO WO 00/23686 4/2000
WO WO 00/45026 8/2000
WO WO 00/45027 8/2000
WO WO 00/79092 12/2000

| | | |
|---|---|---|
| WO | WO 01/03889 A1 | 1/2001 |
| WO | WO 01/09479 | 2/2001 |
| WO | WO 01/38688 | 5/2001 |
| WO | WO 01/66905 | 9/2001 |

OTHER PUBLICATIONS

PCT International Preliminary Examination Report from International application PCT/GB00/04383, Dated Feb. 26, 2002.

PCT International Search Report, International Application No. PCT/US 03/03195, dated Oct. 22, 2003.

British Search Report dated Jun. 18, 2001, for application No. GB0028313.5.

PCT International Search Report dated Feb. 28, 2002, for application No. PCT/GB01/05121.

* cited by examiner

ADAPTER FRAME FOR A POWER FRAME

CROSS-REFERENCE TO RELATED APPLICATION

This application claims benefit of U.S. Provisional Patent Application Ser. No. 60/503,822, filed on Sep. 19, 2003, which application is herein incorporated by reference in its entirety.

BACKGROUND OF THE INVENTION

1. Field of the Invention

The present invention generally relates to an apparatus for transporting a tubular handling apparatus. Particularly, the present invention relates an apparatus for reducing a load on a frame for transporting a tubular handling apparatus. More particularly still, the present invention relates to a support frame adapted for use with a power frame for transporting a tubular handling apparatus.

2. Description of the Related Art

In the construction of oil or gas wells it is usually necessary to construct long drill pipes. Due to the length of these pipes, sections or stands of pipe are progressively added to the pipe string as it is lowered into the well from a drilling platform. In particular, when it is desired to add a section or stand of pipe, the pipe string is usually restrained from falling into the well by applying the slips of a spider located in the floor of the drilling platform. The new section or stand of pipe is then moved from a rack to the well center above the spider. The threaded pin of the section or stand of pipe to be connected is then located over the threaded box of the pipe string in the well and the connection is made up by rotation therebetween. Thereafter, the newly extended pipe string is released from the spider. The whole pipe string is then lowered until the top of the pipe section is adjacent the spider whereupon the slips of the spider are re-applied to maintain the pipe string in the wellbore.

It is common practice to use a tong assembly apply a predetermined torque to the connection in order to make this connection. The tong assembly is typically located on the platform, either on rails, or hung from a derrick on a chain. In order to make up or break out a threaded connection, the tong assembly has a two tong arrangement. An active (or wrenching) tong supplies torque to the section of pipe above the threaded connection, while a passive (or back up) tong supplies a reaction torque below the threaded connection. Particularly, the back up tong clamps the pipe below the threaded connection, and prevents it from rotating. The clamping of the pipe string may be performed mechanically, hydraulically, or pneumatically. The wrenching tong clamps the upper part of the connection and is driven so that it supplies torque for a limited angle.

This power tong arrangement may also be used to make up connections between other tubulars, for example casing and tubing. Although the arrangement remains the same, the tongs may be replaced or changed for different sized tubulars. This is because tongs are typically adapted for use within a range of tubular sizes. Therefore, tongs are generally changed as the tubular sizes vary.

Conventionally, power tongs including the two tong arrangement described above and other commercially available tongs are suspended by chains from a crane or other support. However, the chains may get in the way of other equipment. For example, the chains may block access to a drill pipe spinner which is used to partially make up a threaded connection before a final tightening of the connection by the wrenching and backup tongs.

There is a need, therefore, for an apparatus for providing support for a tong assembly that reduces equipment interferences during operation. There is also a need for an apparatus for reducing a load on a frame for transporting a tubular handling apparatus. There is a further need for an adapter frame that may be used with a power frame for supporting a tong assembly.

SUMMARY OF THE INVENTION

In one embodiment, an adapter frame is provided for use with a power frame to support a tong assembly. When the adapter frame is coupled to the power frame, the load capacity of the power frame is increased, thereby allowing the power frame to be used with larger tongs or tong assemblies such as a riser tong.

In another embodiment, a tong support assembly for use with a tong is provided. The tong support assembly includes a movable frame for supporting the tong and an adapter frame coupled to the movable frame and adapted to increase a load capacity of the movable frame. Additionally, the tong support assembly may have an extendable support member for positioning the tong and a motive member for moving the movable frame and the tong.

In another embodiment, an adapter frame for use with a movable frame for transporting a tubular handling apparatus is provided. The adapter frame includes an extendable support member and a retaining device coupled to the extendable support member for retaining the tubular handling apparatus. A connection member may be used to couple the adapter frame to the movable frame In yet another embodiment, a transport apparatus for transporting a tubular handling device is provided. The transport apparatus comprises a power frame and an adapter frame coupled to the power frame, wherein the adapter frame partially supports a weight of the tubular handling device.

In another embodiment, a transport apparatus for transporting a tubular handling device includes a power frame having a motive member; an adapter frame coupled to the power frame; a retaining member for retaining the tubular handling device; and an extendable structure for positioning the tubular handling device, wherein the adapter frame at least partially supports a weight of the tubular handling device.

In another embodiment, an apparatus for handling a tubular handling device comprises a support frame for supporting the tubular handling device and an adapter frame coupled to the support frame, wherein the adapter frame increases a load capacity of the support frame.

In another embodiment, an apparatus for handling a tong comprises a tong support structure for supporting the tong and an adapter coupled to the tong support structure, wherein the adapter increases a load capacity of the tong support structure.

BRIEF DESCRIPTION OF THE DRAWINGS

So that the manner in which the above recited features can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

In one embodiment, an adapter frame is provided for use with a power frame to support a tong assembly. When the adapter frame is coupled to the power frame, the load capacity of the power frame is increased, thereby allowing the power frame to be used with larger tongs or tong assemblies such as a riser tong.

Figure 6:
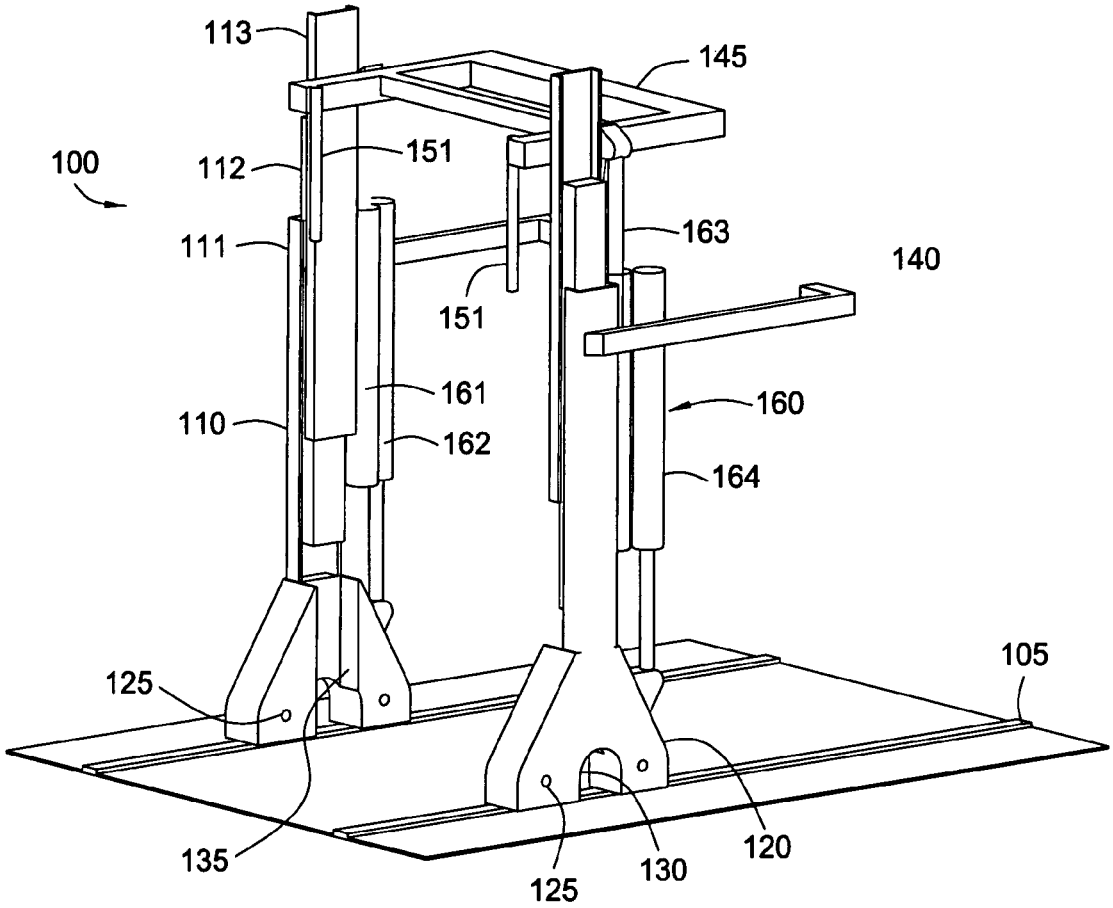
FIG. 6 shows an embodiment of the adapter frame.
Figure 7:
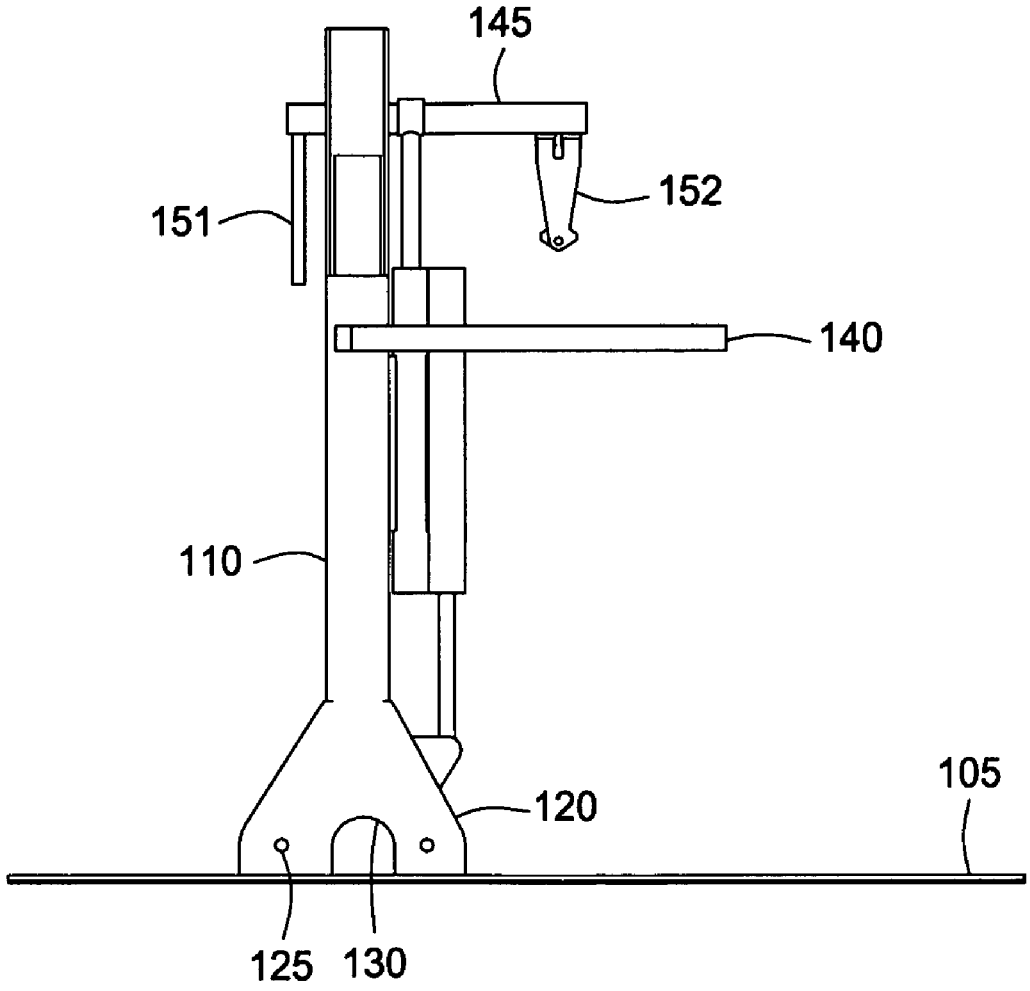
FIG. 7 shows a side view of the adapter frame.
Figure 8:
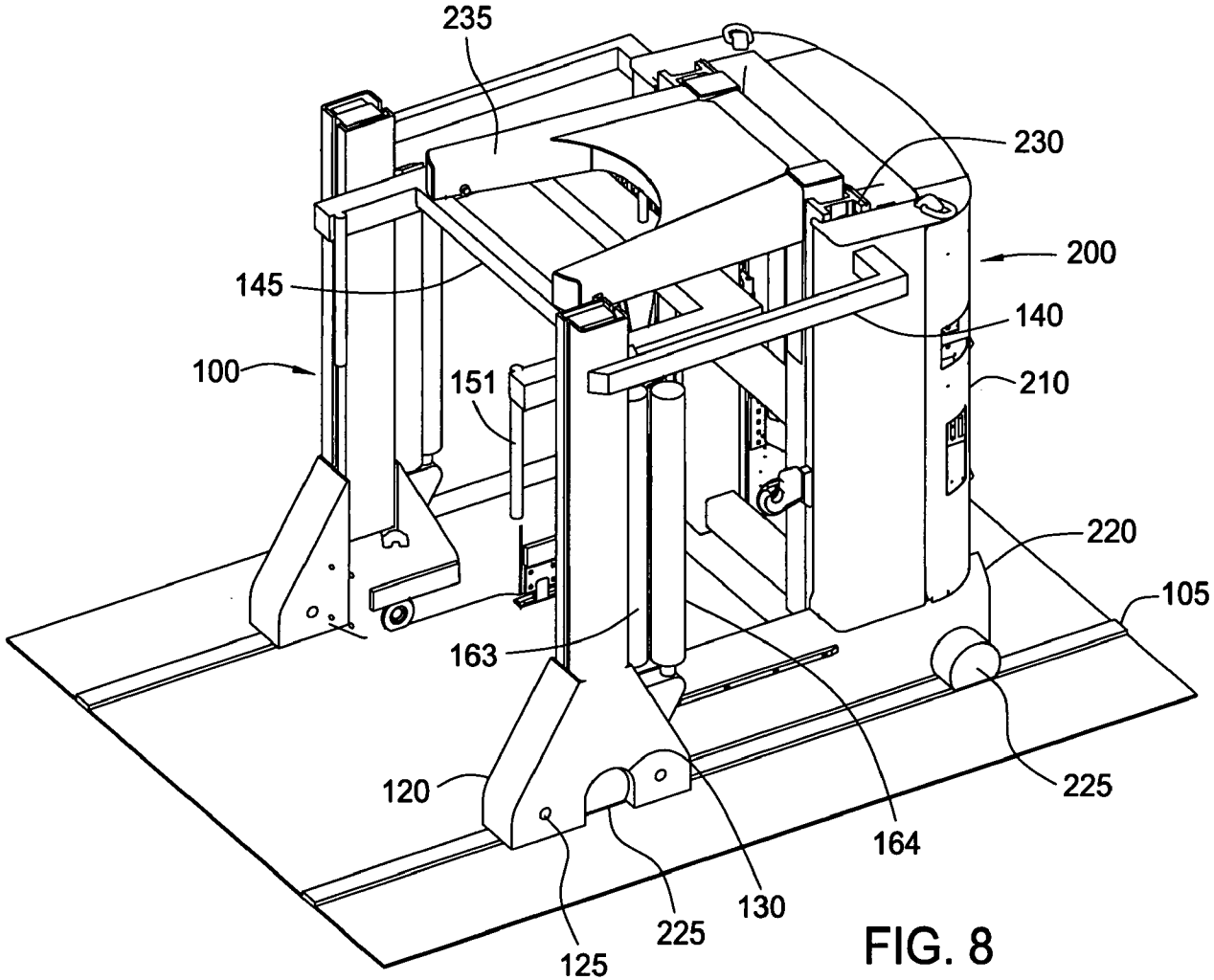
FIG. 8 shows the adapter frame coupled to a power frame.
Figure 9:
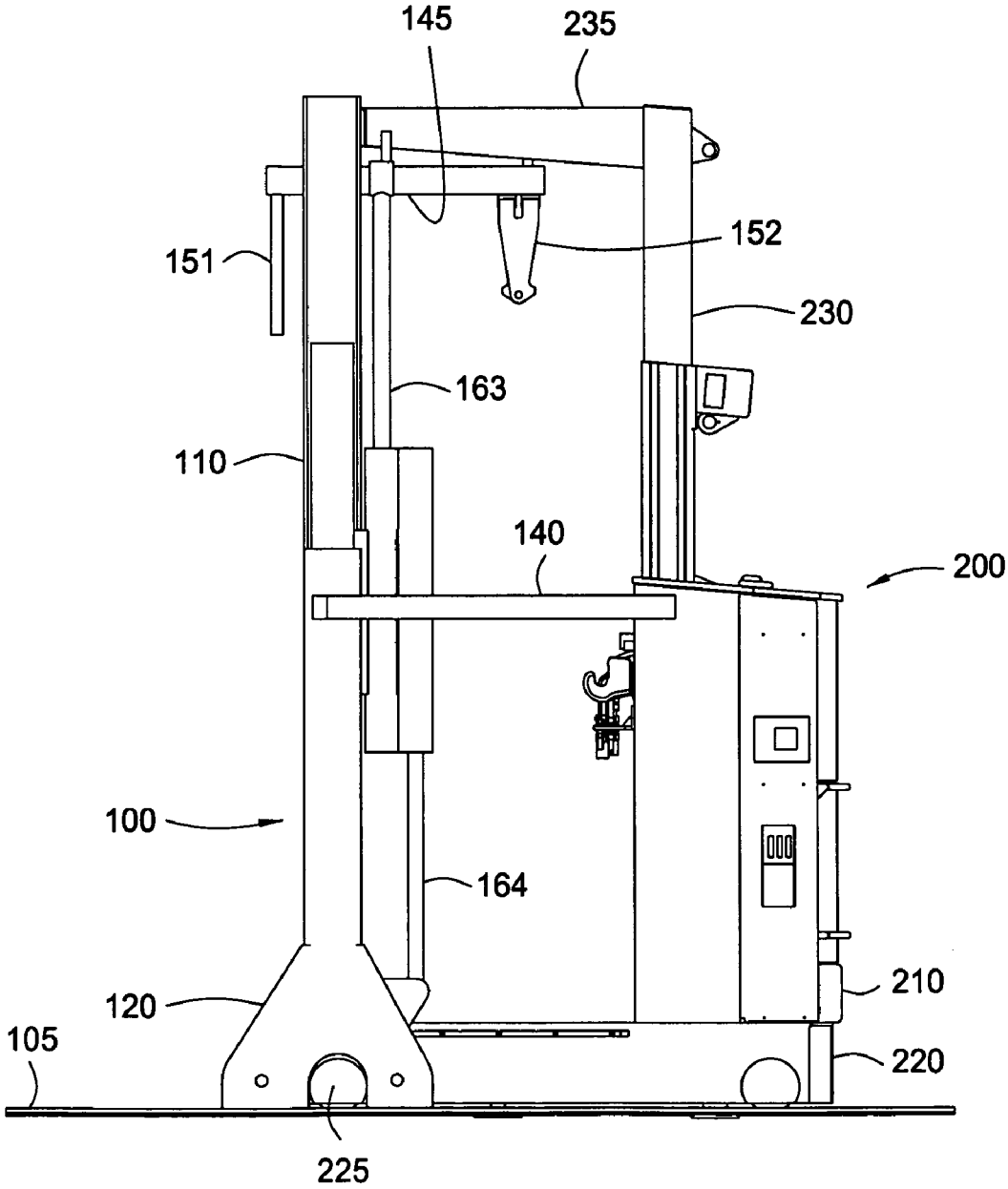
FIG. 9 shows a side of the adapter frame coupled to the power frame.

FIGS. 6–7 show an embodiment of an adapter frame 100. FIGS. 8–9 show the adapter frame 100 coupled to a power frame 200. The coupled frames 100, 200 may be used to support a tong assembly 300 as illustrated in FIGS. 10–13.

Referring to FIG. 6, the adapter frame 100 is shown disposed on a rail system 105. The adapter frame 100 includes a pair of extendable support members 110 disposed on a support base 120. The support base 120 rides on the rail system 105 using one or more wheels. As shown, two wheels are used to move each support base 120. The wheels are connected to the support base 120 using a pin or bolt 125. An opening 130 is formed in the support base 120 to accommodate the wheels 225 of the power frame 200, as illustrated in FIGS. 6 and 8. The support base 120 may also include a recessed joint 135 for coupling with the power frame 200. Preferably, the recessed joint 135 is formed in a substantially vertical direction relative to the rig floor to facilitate transportation of the adapter frame 100 by the power frame 200. In this respect, the vertical recessed joint 135 substantially isolates the load from the front wheels 225 of the adapter frame 100. In this manner, the vertical recessed joint 135 allows the power frame 200 to move the adapter frame 100 without providing additional forces to its front wheels 225. In another embodiment, the extendable support member 110 may be positioned substantially perpendicular to the movable base 220 of the power frame 200.

In one embodiment, the extendable support member 110 may comprise a fixed member 111, an inner member 112, and an outer member 113. As the extendable support member 110 is extended, the inner member 112 and the outer member 113 may independently move relative to the fixed member 111. However, it must be noted that other suitable extendable support members known to a person of ordinary skill in the art may be used without deviating from aspects of the present invention.

The adapter frame 100 includes one or more attachment arms 140 for coupling the adapter frame 100 to the power frame 200. One end of the attachment arm 140 is attached to the extendable support member 110, and the other end may be attached to the body 210 of the power frame 200. The attachment arm 140 and the recessed joint 135 work in combination to allow the adapter frame 100 to be moved by the power frame 200 as a single unit.

In another aspect, a tong support member 145 may be attached to the outer member 113 of the extendable support member 110. The tong support member 145 may include one or more retaining members 151, 152 for retaining the tong assembly. In the embodiment shown in FIG. 7, a pair of retaining members 151 is disposed in the front of the tong support member 145 and a pair of retaining members 152 is disposed in the back. Preferably, the retaining members in the front comprise a chain 151, and the retaining members in the back comprise a gripping member 152.

The tong support member 145 may be raised or lowered using one or more actuators 160. In one embodiment, the actuator 160 may comprise a piston and cylinder assembly. In FIG. 6, four piston and cylinder assemblies 161, 162, 163, 164 are used to move the tong support member 145. Preferably, a pair of piston and cylinder assemblies 161, 162, 163, 164 is disposed on each side of the adapter frame 100. More preferably, the pair of piston and cylinder assemblies is arranged such that the piston of one assembly 163 is coupled to the tong support member 145, while the piston of the other assembly 164 is coupled to the support base 120. In the preferred embodiment, equal pressure is applied to the four piston and cylinder assemblies 161, 162, 163, 164 during operation. Equal pressure may be applied by a hydraulic compensation circuit. It is envision that the piston and cylinder assemblies may be operated by any manner known to a person of ordinary skill in the art, including hydraulically, pneumatically, and mechanically.

The adapter frame 100 may be coupled to a power frame 200 to reduce the load on the power frame 200, as shown in FIG. 8. An exemplary power frame is disclosed in U.S. patent application Ser. No. 10/432,059, filed on May 15, 2003 and published as U.S. Publication No. 20040035573, on Feb. 26, 2004, which claims priority to International Application Number PCT/GB01/05121, filed on Nov. 19, 2001 and published on May 30, 2002 as International Publication Number WO 02/42600, which applications are herein incorporated by reference in their entirety. In one aspect, the power frame 200 may include a body 210 disposed on a movable base 220. The base 220 includes a drive member such as a plurality of wheels 225 that ride on a rail system 105. The body 220 includes an extendable body member 230 having a hanger 235 disposed at an upper end. In this respect, the power frame 200 acts as a movable tong support structure when a tong assembly is attached to the hanger. Additionally, the extendable body member 230 allows the tong assembly to be properly positioned to engage the tubulars to be connected. In one embodiment, the hanger 235, body 210, and the movable base 220 are arranged in the shape of a C, such that the power frame 200 may also be referred to as a C-frame. The power frame 200 is equipped with a power mechanism to extend or retract the extendable body member 230. Suitable power mechanisms include a piston and cylinder assembly, a powered pulley system, or other mechanisms known to a person of ordinary skill in the art.

The power frame 200 and the adapter frame 100 may be coupled together at one or more points of contact to form a tong support assembly for supporting and positioning a tong assembly. In one embodiment, the attachment arm 140 connects the two frames 100, 200 together. In another embodiment, the support base 120 is connected to the movable base 220 of the power frame 200 using the vertical recessed joint 135. The opening 130 in the support base 120 allows the support base 120 to be placed over the wheels 225 of the power frame 200. In another embodiment still, the hanger 235 may be connected to the tong support member 145. Preferably, the adapter frame 100 is coupled to the power frame 200 using all three of these points of contact.

In another aspect, the tong support assembly 100, 200 may be used to support various gripping systems including a tong assembly 300, as shown in FIGS. 10–13. The tong assembly 300 is supported in the tong support assembly 100, 200 using the retaining members 151, 152 of the adapter frame 100. An exemplary tong assembly capable of being supported by the tong support assembly is disclosed in U.S. patent application Ser. No. 10/074,947, filed on Feb. 12, 2002 and published as U.S. Patent Publication No. 2002/0157823 on Oct. 21, 2002, which application is herein incorporated by reference in its entirety.

Figure 1:
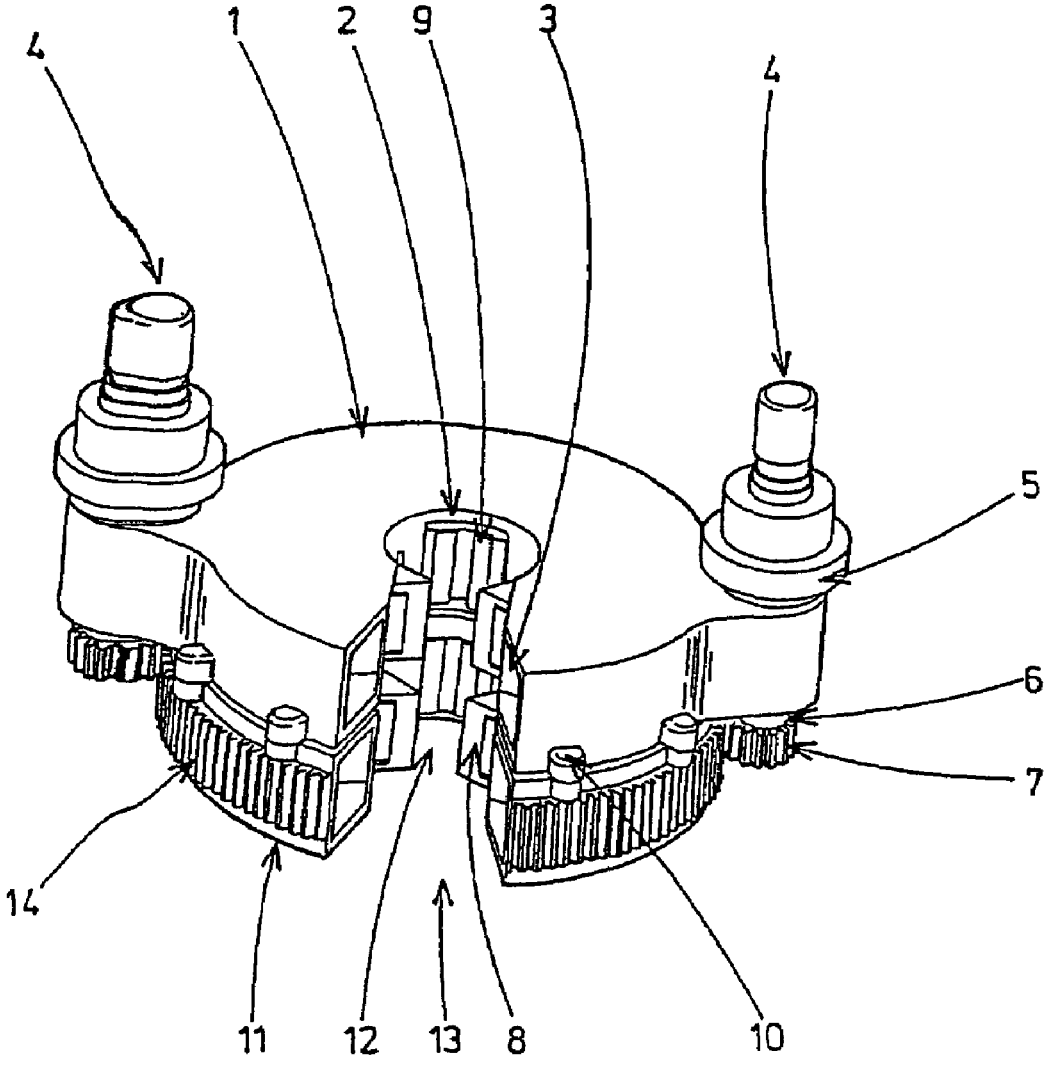
FIG. 1 illustrates an exemplary tong assembly usable with the adapter frame. The tong assembly includes a wrenching tong and a backup tong.
Figure 2:
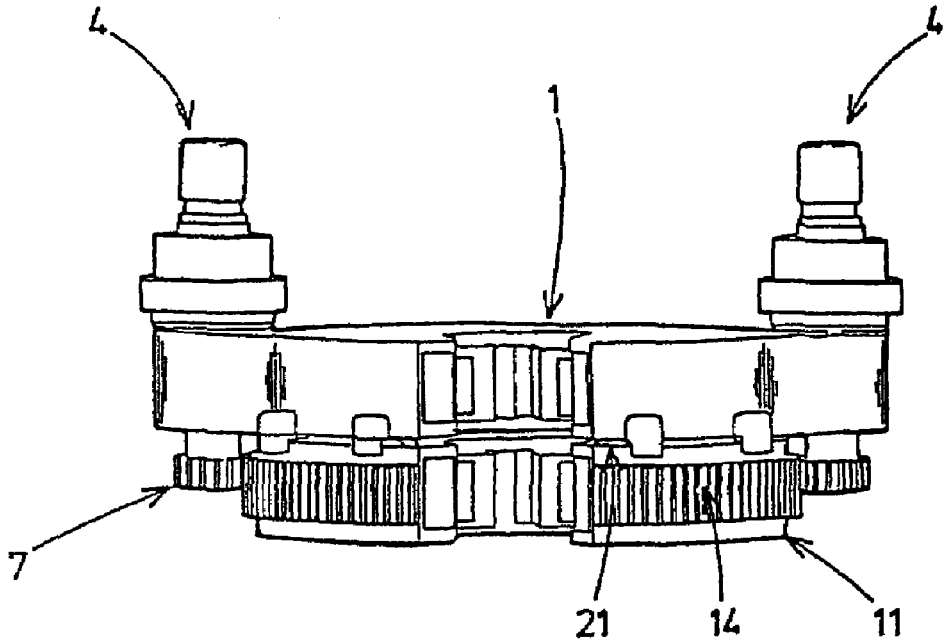
FIG. 2 is another view of the tong assembly.

A suitable tong assembly 305 is shown in FIGS. 1–5. As shown in FIGS. 1 and 2, the tong assembly 305 may include a wrenching tong and a back-up tong. The wrenching tong 1 is generally in the form of a disc with an opening 2 through the center thereof for receiving a stand of drill pipe (not shown), and a recess 3 cut from the edge to the opening 2 at the center. The wrenching tong 1 is provided with two pinion drives 4 arranged opposite each other at the periphery of the disc, equally spaced either side of the recess 3. Each pinion drive 4 comprises a drive motor 5, drive shaft 6, and pinion 7 attached to the drive shaft 6.

A back-up tong 11 is located beneath the wrenching tong 1. The back-up tong 11 is generally in the form of a disc with similar dimensions to the wrenching tong 1. The back-up tong 11 is also provided with an opening 12 through the center and a recess 13 from the edge to the opening 12 at the center. The opening 12 and recess 13 correspond to the opening 2 and recess 3 of the wrenching tong 1 when the back-up tong 11 and the wrenching tong 1 are correctly aligned.

A plurality of guide rollers 10 or other guide elements are spaced around the edge of the wrenching tong 1 in order to maintain the alignment of the wrenching tong 1 with the back-up tong 11.

A gear 14 is provided around the periphery of the back-up tong 11, broken by the recess 13. The gear 14 meshes with the pinions 7 attached to the motors 5 on the wrenching tong 1, so that when the drive motors 5 drive the drive shafts 6 and gears 7, the wrenching tong 1 rotates relative to the back-up tong 11. The angle of rotation is limited by the recess 13 of the back up tong 11.

Figure 3:
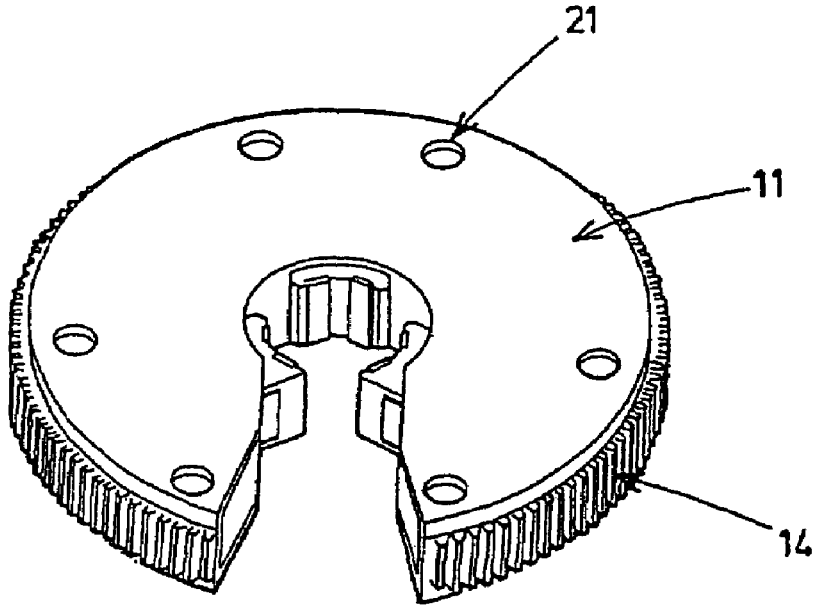
FIG. 3 shows the backup tong with a portion of its housing removed for clarity.

FIG. 3 shows a back-up tong 11 before the wrenching tong 1 is placed on top of it. The back-up tong 11 has a plurality of roller bearings 21, upon which the wrenching tong 1 is designed to be placed. The roller bearings 21 are supported by resilient means such as springs, elastic material or hydraulic/pneumatic cylinders, in order to support the wrenching tong 1 during wrenching. During one wrenching cycle, the pipe stands will move axially relative to one another as the connection is tightened. The wrenching tong 1 must follow the axial movement of the top stand during one wrenching cycle. This axial travel length depends on the pitch of the thread.

Three clamping jaws 8 equipped with dies 9 are located inside each of the wrenching tong 1 and back-up tong 11. These are hydraulically driven for clamping the drill pipe stand in place in the center of the wrenching tong 1. The hydraulic power supply may be provided by hoses (not shown). It must be noted that any number of clamping jaws may be used to grip the tubulars. For example, one or both of the tongs 1, 11 may be equipped with two clamping jaws. Additionally, either or both of the tongs 1, 11 may be provided with pinion drives 4.

Figure 4:
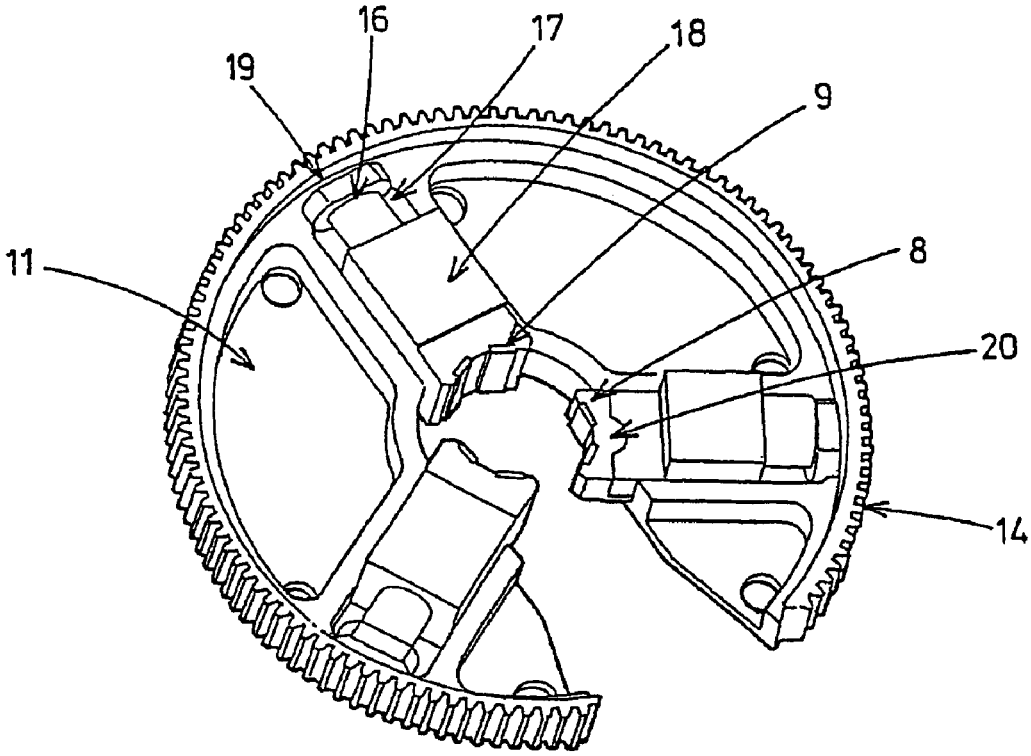
FIG. 4 is a cross-sectional view of the back-up tong.
Figure 5:
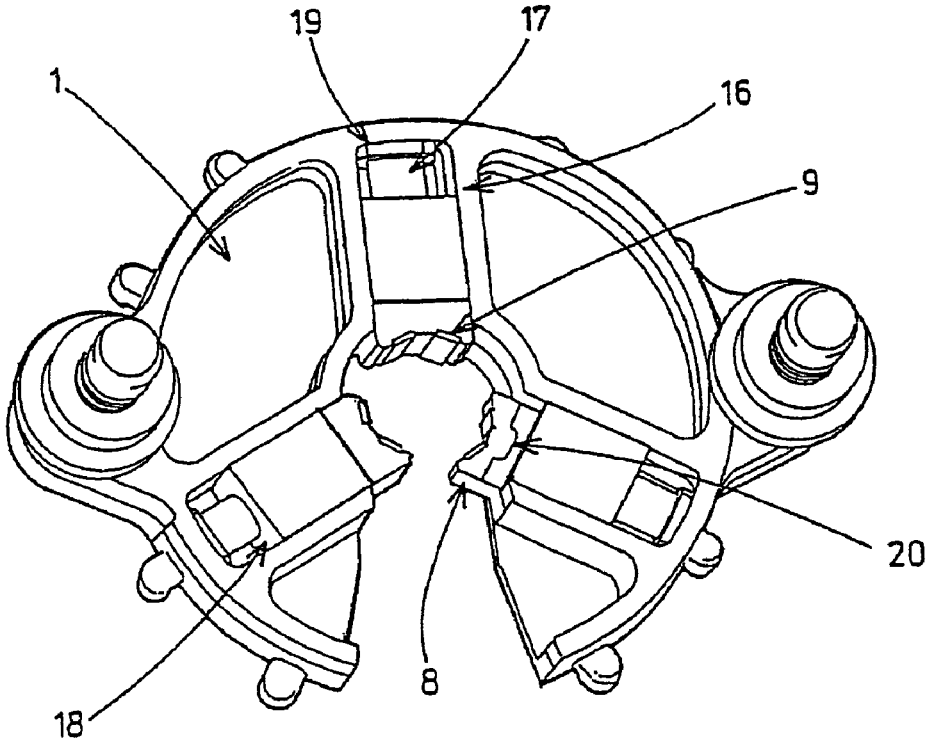
FIG. 5 depicts the wrenching tong with a portion of its housing removed for clarity.

FIG. 4 shows the clamping mechanism of the back-up tong 11. Three hydraulic pistons 16, comprising piston rods 17 and chambers 18, are located inside the casing of the back-up tong 11. Each piston rod 17 has an end 19 which is secured to the outside edge of the back-up tong 11. At the other end of the piston rod 17, the jaw 8 containing two dies 9 with teeth (not shown) is fixed to the chamber 18 by a spherical bearing 20. With the arrangement shown, each drill pipe stand is clamped by three jaws 8 and six dies 9 at the joint. The spherical bearings 20 enable the jaws 8 and dies 9 to match the pipe surfaces closely, resulting in a low penetration depth of the teeth of the dies 9 into the pipe surface, and thus prolonging the life of the drill pipe. The wrenching tong 1 has a similar clamping jaw design, as shown in FIG. 5.

Figure 10:
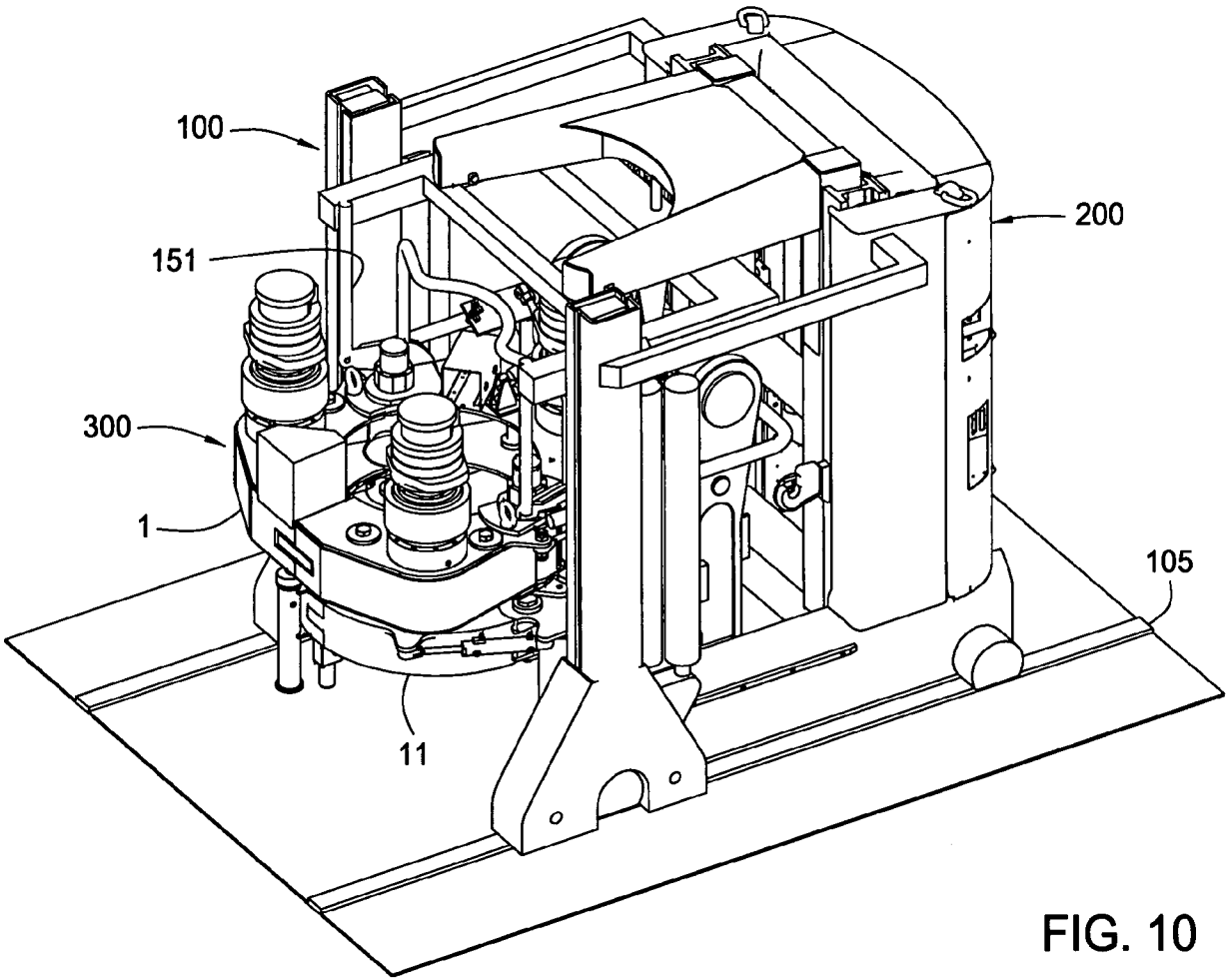
FIG. 10 shows a tong assembly supported by the adapter frame and the power frame.
Figure 11:
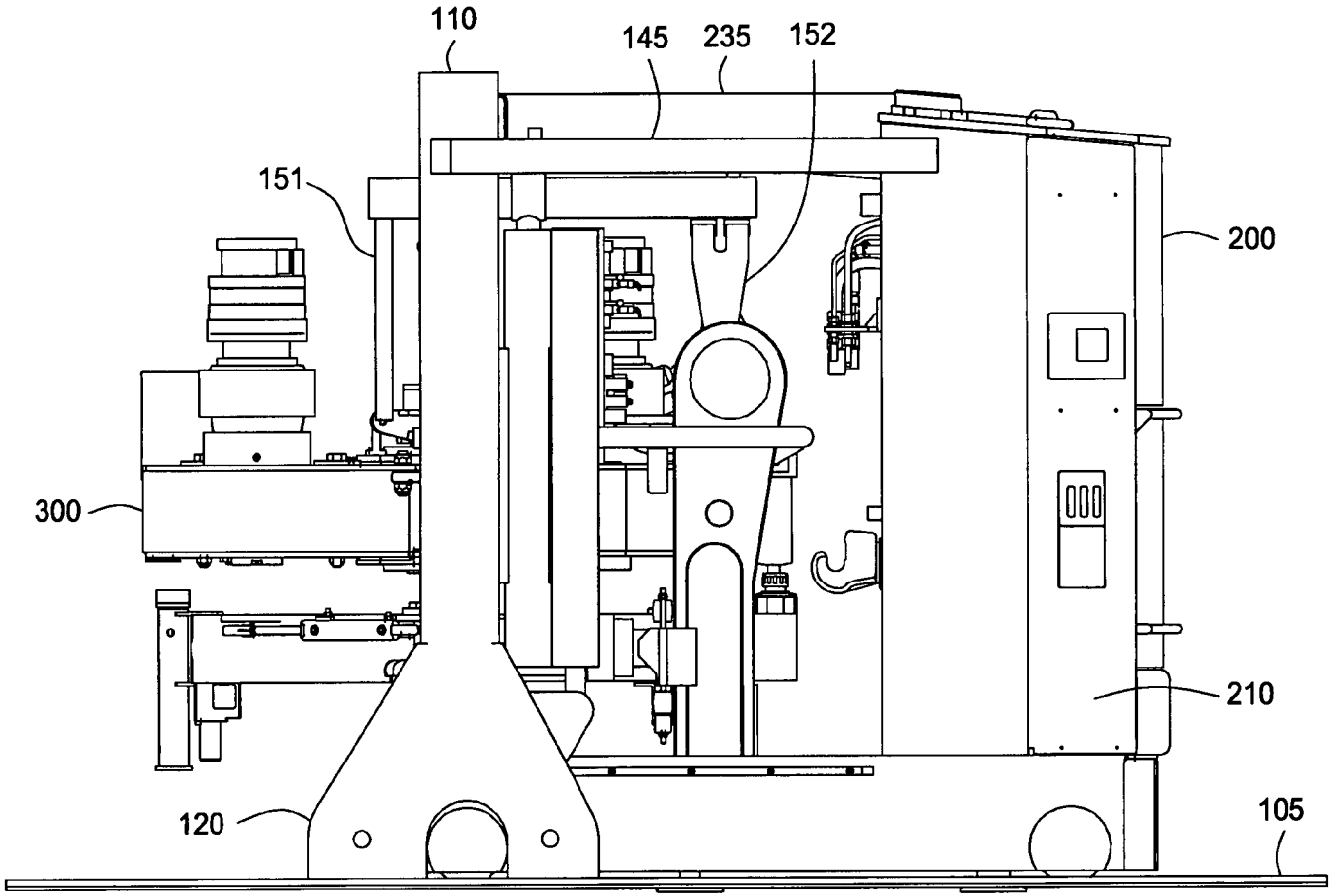
FIG. 11 shows a side view of the tong assembly supported by the adapter frame and the power frame.

In operation, the adapter frame 100 is attached to the power frame 200 to form the tong support assembly for supporting and/or transporting the tong assembly 300, as illustrated in FIG. 10. As shown in FIGS. 10 and 11, the tong assembly 300 may be retained using the retaining members 151, 152 provided on the adapter frame 100. A portion of the load from the tong assembly 300 is supported by the adapter frame 100, while the remaining portion is supported by the power frame 200. In this manner, the power frame 200 may be adapted to handle heavier gripping systems, such as a riser tong. The tong support assembly 100, 200 and the tong assembly 300 initially rests on the rail system 105. The coupled unit 100, 200, 300 may be moved as a single unit along the rail system 105 to and away from the tubulars to be connected.

Figure 12:
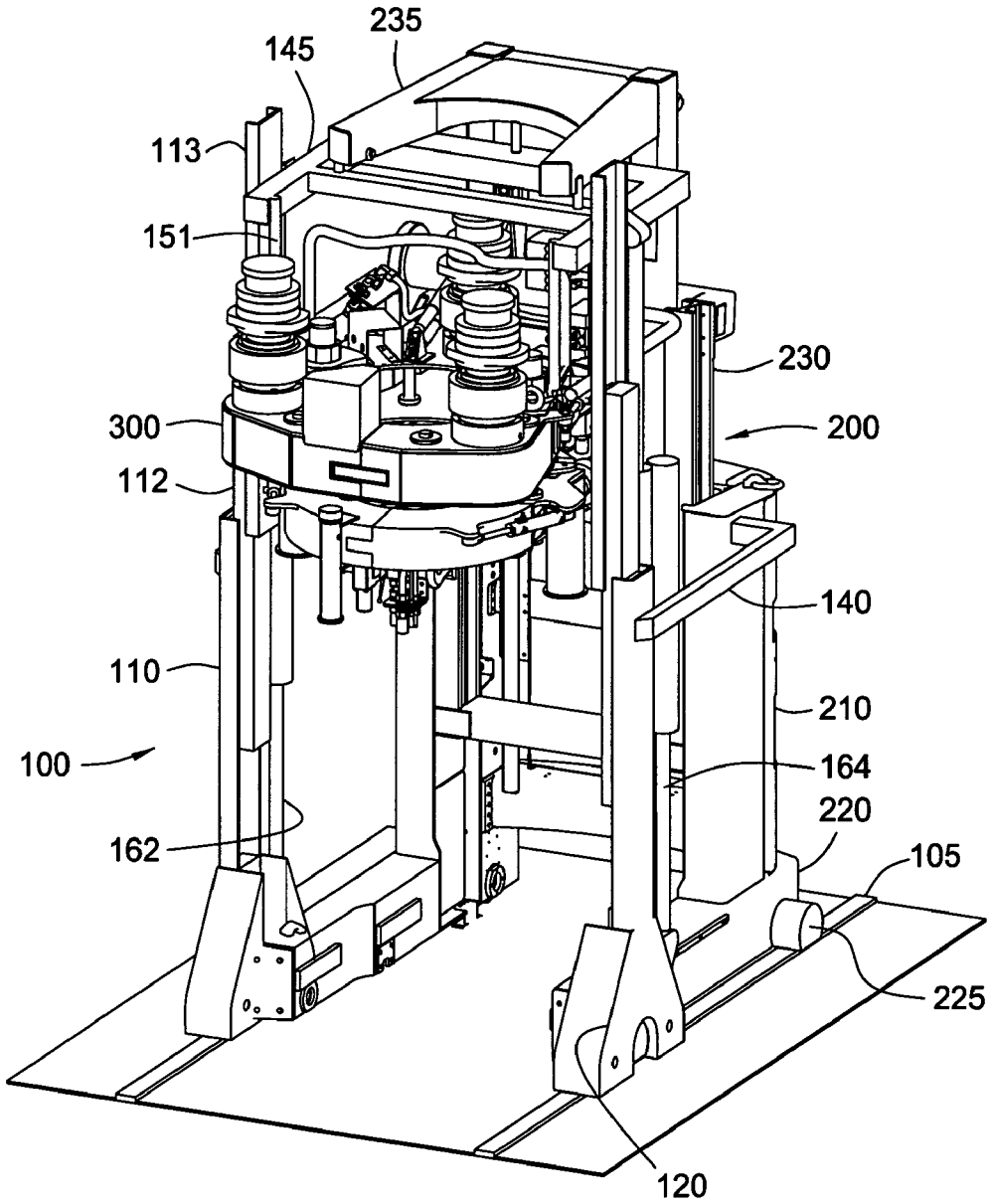
FIG. 12 shows the tong assembly in an extended position.
Figure 13:
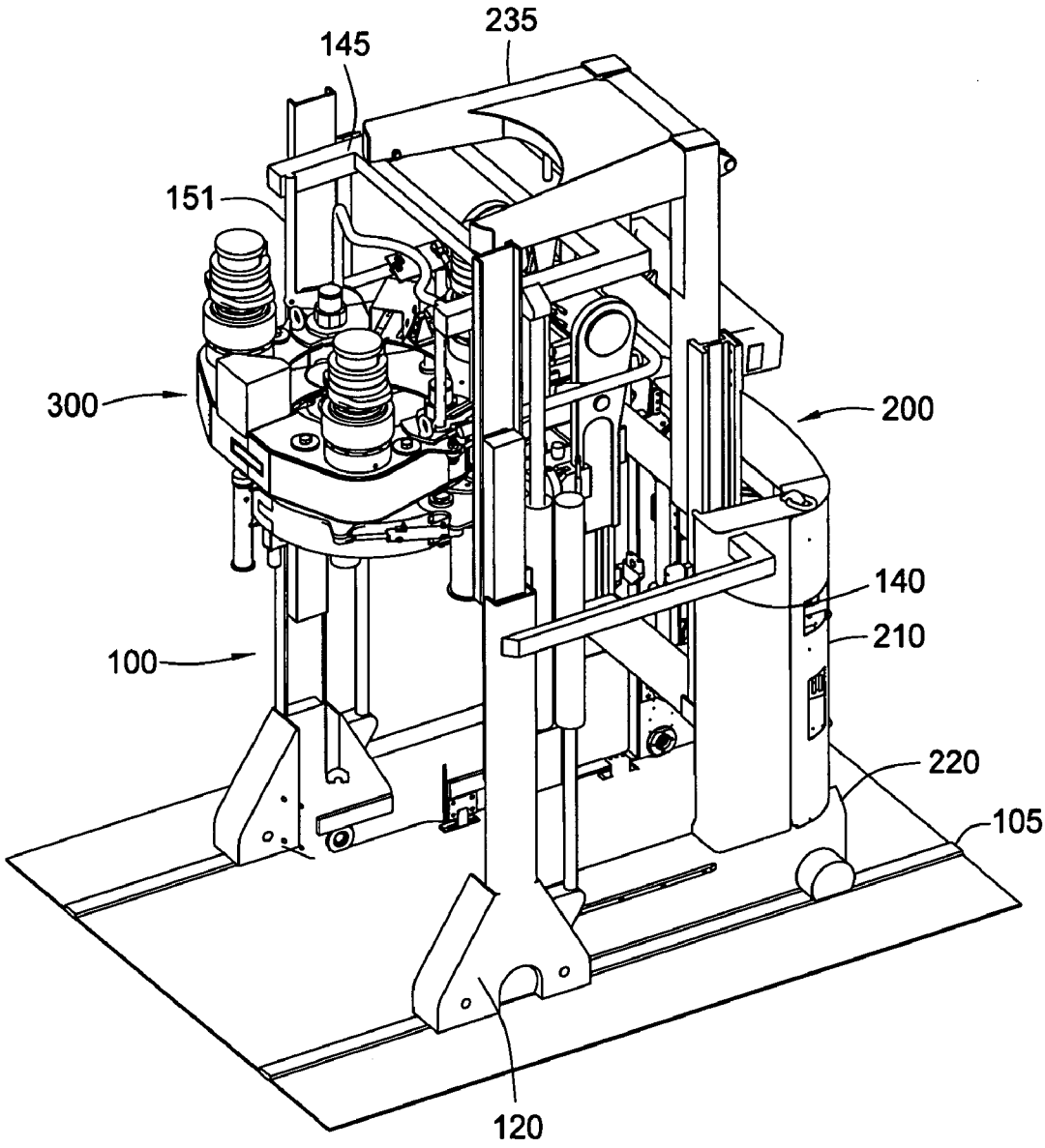
FIG. 13 shows another view of the tong assembly.

Once the tong assembly 300 is positioned in the proximity of the tubulars, the power frame 200 may be actuated to raise or lower the tong assembly 300 to place the tongs 1, 11 in position for engagement with the tubulars. Upon actuation, equal pressure is supplied to the piston and cylinder assemblies 161–164 of the adapter frame 100 to raise or lower the tong assembly 300, as illustrated in FIGS. 12 and 13. In this respect, the wrenching tong 1 and the back-up tong 11 may be situated to engage the tubulars for connection. FIG. 14 is another view of the tong assembly 300 in the raised position.

While the foregoing is directed to embodiments of the present invention, other and further embodiments of the invention may be devised without departing from the basic scope thereof, and the scope thereof is determined by the claims that follow.

I claim:

1. A tong support assembly for use with a tong, comprising:

a movable frame disposed on a rig floor for supporting the tong;

an adapter frame coupled to the movable frame and adapted to remove at least a portion of a load of the tong from the movable frame, the adapter frame having an extendable support member for positioning the tong, wherein the movable frame and the adapter frame have independent contact points with the rig floor; and a motive member for moving the movable frame and the tong.

2. The tong support assembly of claim 1, wherein the adapter frame includes a support base for supporting the extendable support member.

3. The tong support assembly of claim 2, wherein the support base comprises a connection apparatus for coupling with the movable frame.

4. The tong support assembly of claim 1, further comprising:

an actuator for extending the support member.

5. The tong support assembly of claim 4, wherein the actuator comprises one or more piston and cylinder assemblies for extending the support member.

6. The tong support assembly of claim 1, wherein the adapter frame includes one or more retaining members for retaining the tong.

7. The tong support assembly of claim 1, wherein the extendable support member is adapted to move the tong along a vertical axis.

8. The tong support assembly of claim 1, wherein the adapter frame comprises a second motive member.

9. The tong support assembly of claim 1, wherein the adapter frame is connected to the tong.

10. The tong support assembly of claim 1, wherein the respective contact points are movable.

11. The tong support assembly of claim 1, wherein the motive member comprises one or more wheels connected to the movable frame.

12. An adapter frame for use with a movable frame disposed on a rig floor for supporting a tubular handling apparatus, comprising:

an extendable support member for positioning the tubular handling apparatus;

a connection member for coupling the adapter frame to the movable frame; and a retaining device coupled to the extendable support member for retaining the tubular handling apparatus, wherein the adapter frame is adapted to transfer at least a portion of a load of the tubular handling apparatus directly to the rig floor and the movable frame and the adapter frame have independent contact points with the rig floor.

13. The adapter frame of claim 12, further comprising:

a support base for supporting the extendable support member.

14. The adapter frame of claim 12, wherein the movable frame is adapted to support the remaining load of the tubular handling apparatus.

15. The adapter frame of claim 12, further comprising:

an actuator for extending the support member.

16. The adapter frame of claim 12, further comprising one or more piston and cylinder assemblies for extending the support member.

17. The adapter frame of claim 12, wherein the tubular handling apparatus comprises a rotary tong.

18. A transport apparatus for transporting a tubular handling device on a rig floor, comprising:

a power frame having a motive member, the power frame disposed on a first location on the rig floor;

an adapter frame coupled to the power frame, the adapter frame disposed on a second location on the rig floor, wherein the power frame and the adapter frame have independent contact points with the rip floor;

a retaining member for retaining the tubular handling device; and an extendable structure for positioning the tubular handling device, wherein the adapter frame at least partially supports a weight of the tubular handling device.

19. The transport apparatus of claim 18, wherein the extendable structure is adapted to move the tubular handling device along a vertical axis.

20. The transport apparatus of claim 18, wherein the adapter frame is movable with the power frame.

21. The transport apparatus of claim 20, wherein the adapter frame is supported on a base of the power frame.

22. The transport apparatus of claim 21, wherein the motive member comprises one or more wheels connected to the base.

23. The apparatus of claim 18, wherein the tubular handling device comprises a riser tong.

24. The transport apparatus of claim 18, wherein the retaining member is connected to the adapter frame.

25. The transport apparatus of claim 18, wherein the extendable structure comprises a component of the adapter frame.

26. The transport apparatus of claim 25, wherein the retaining member is connected to the adapter frame.

27. A tong assembly, comprising:

a tong;

a movable frame for supporting the tong;

an adapter frame selectively coupled to the movable frame and adapted to remove at least a portion of a load of the tong from the movable frame, the adapter frame having an extendable support member for positioning the tong, wherein the movable frame is capable of supporting the tong without the adapter frame coupled to the movable frame; and wherein the movable frame and the adapter frame have independent contact points with the rig floor.

28. The tong assembly of claim 27, wherein the tong comprises a wrenching tong and a back-up tong.

29. The tong assembly of claim 27, wherein the tong comprises a riser tong.

30. The tong assembly of claim 27, wherein the adapter frame comprises a motive member for moving the movable frame and the tong.

31. The transport apparatus of claim 30, wherein the motive member comprises one or more wheels connected to the movable frame.

* * * * *

UNITED STATES PATENT AND TRADEMARK OFFICE

CERTIFICATE OF CORRECTION

PATENT NO. : 7,188,548 B2
APPLICATION NO. : 10/945568
DATED : March 13, 2007
INVENTOR(S) : Martin Liess It is certified that error appears in the above-identified patent and that said Letters Patent is hereby corrected as shown below:

In the Claims:

In Column 8, Claim 18, Line 8, please delete "rip" and insert --rig--.

Signed and Sealed this

Tenth Day of July, 2007

JON W. DUDAS
*Director of the United States Patent and Trademark Office*